US009286865B2

(12) United States Patent
Loschiuk et al.

(10) Patent No.: US 9,286,865 B2
(45) Date of Patent: Mar. 15, 2016

(54) STRING INSTRUEMNT BOW AND METHOD OF USING SAME

(71) Applicants: Peter Loschiuk, Coquitlam (CA); Stephen Fowler, Coquitlam (CA)

(72) Inventors: Peter Loschiuk, Coquitlam (CA); Stephen Fowler, Coquitlam (CA)

( * ) Notice: Subject to any disclaimer, the term of this patent is extended or adjusted under 35 U.S.C. 154(b) by 71 days.

(21) Appl. No.: 14/286,211

(22) Filed: May 23, 2014

(65) Prior Publication Data

US 2015/0340018 A1 Nov. 26, 2015

(51) Int. Cl.
*G10D 3/16* (2006.01)
*G10D 1/08* (2006.01)

(52) U.S. Cl.
CPC ... *G10D 3/16* (2013.01); *G10D 1/08* (2013.01)

(58) Field of Classification Search
CPC ..... G10D 3/16
USPC ..... 84/325; D17/20
See application file for complete search history.

(56) References Cited

U.S. PATENT DOCUMENTS 6,156,962 A * 12/2000 Poort ..... G10D 3/06 84/314 N
8,183,447 B1 * 5/2012 Chapman ..... G10D 3/06 84/293

* cited by examiner

*Primary Examiner* — Jianchun Qin
(74) *Attorney, Agent, or Firm* — David W. Barman

(57) ABSTRACT

The present invention provides an assembly and method for playing music, whereby the assembly includes a bow spline, string stretched with tension along a portion of said spline, a frame having an apex, said frame positioned between said spline and said string, at least one string retaining member disposed on said apex, and a lower frame portion configured to contact said spline.

2 Claims, 2 Drawing Sheets

STRING INSTRUEMNT BOW AND METHOD OF USING SAME

BACKGROUND OF THE INVENTION

Field of the Invention

Musicians are persons that are continually innovating in their craft. The development of advancements in musical instrumentation continues as it has for centuries. The creative nature of a musician is such that there is constant scrutiny relating to the tools of their craft.

With the invention of the electric guitar, musicians have continually strived for unique ways to produce and modify sound.

The present invention provides a novel addition to the creative tools available to a guitar player.

SUMMARY OF THE INVENTION

In one embodiment, the present invention is an assembly for a string bow comprising:

a bow spline;

string stretched with tension along a portion of said spline;

a frame having an apex, said frame positioned between said spline and said string;

at least one string-retaining member disposed on said apex; and a lower frame portion configured to contact said spline.

In one embodiment, the string comprises a single material. In another embodiment, the string comprises at least two different materials.

The assembly spline has a first, or distal end, and second, or proximal end and the spline has a frog, or heel configured near said second, or proximal end.

In one embodiment, the apparatus includes at least one prong incorporated with said frame apex.

Additionally one embodiment provides the string-retaining member is a string-retaining notch incorporated with at least one notch.

Additionally contemplated is a method of playing an instrument, said method comprising the steps of:

providing an assembly according to any of the configurations or combinations described herein;

providing an article configured to produce sound when contacted with drawing motion of said string;

contacting the string of said assembly with said article configured to produce sound.

Although as generally understood, a bow is used to produce sound on a stringed instrument, the method of the present invention contemplated utilization of the inventive assemble on any surface in which sound can be produced when contacted with the bow string. There are many such surfaces known to musicians. In one non-limiting example, a cymbal will vibrate when contacted with the hair of a string bow.

In one embodiment, the assembly article is configured to produce sound is a stringed instrument.

In one embodiment, the assembly article is configured to produce sound is a guitar.

In one embodiment, it is contemplated to use more than one assembly with a single article configured to produce sound.

DETAILED DESCRIPTION OF THE PREFERRED EMBODIMENT

Figure 2:
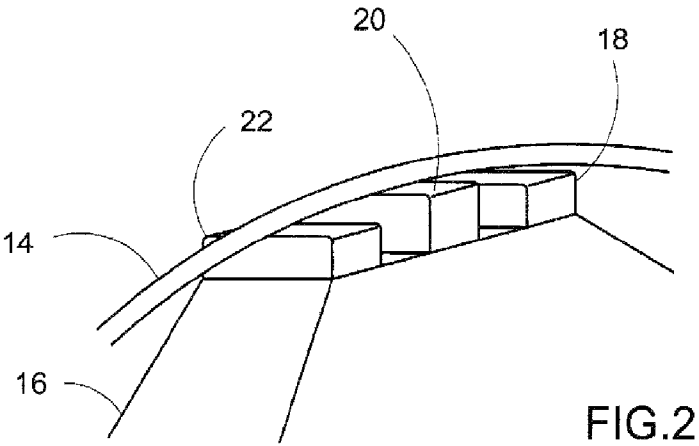
FIG. 2 is a partial enlarged isometric view of the top of the frame portion according to the present invention.

The present invention includes a string instrument bow assembly 10 that includes a bow spline 12 and hair string 14. As is commonly understood in the art, hair string 14 is stretched the length of bow spline 12 connected at a first, or distal end and a second, or proximal end, whereby the proximal end includes a frog or heel operatively associated with a tension screw.

In the present invention, frame 16 is positioned above spline 12 and below string 14 as demonstrated in the accompanying figures. Frame 16 is configured with an elevated apex having a first prong 18 a central prong 20 a third prong 22. Although the particular embodiment demonstrated in the figures provides for a three-prong arrangement, it is generally understood that the number of prongs is varied and then increase or decrease in the number of prongs could additionally be utilized. In one embodiment, each prong configured with a general flat or planer upper surface and string 14 is positioned and held in place by tension. In another embodiment, one or more of first prong 18 a central prong 20 a third prong 22 having u-shaped channel configured with in two raised sides constructed and arranged such that hair string 14 passes through each prong.

Figure 1:
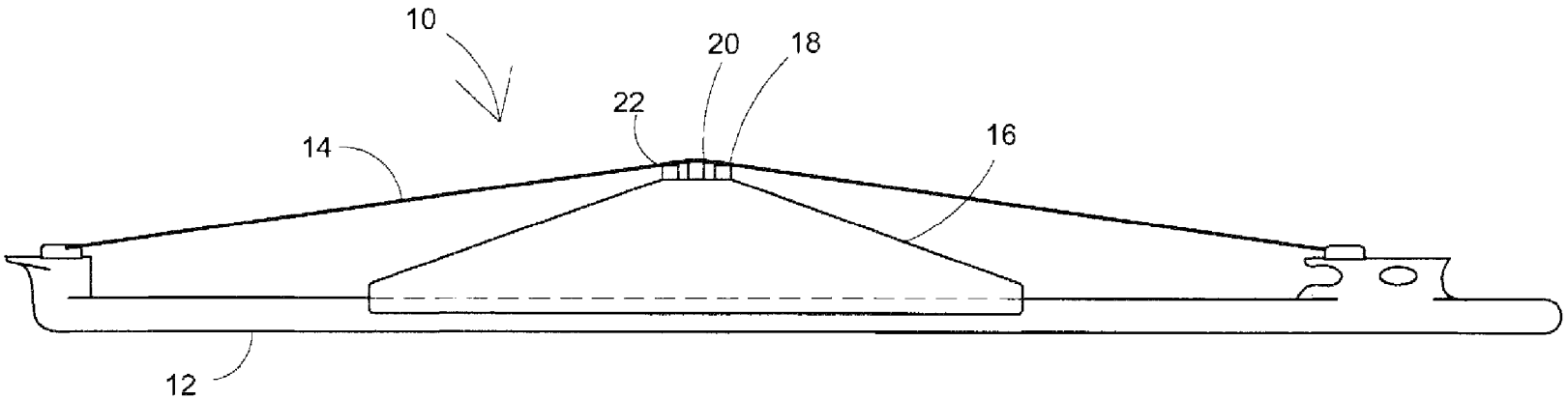
FIG. 1 is a plan view of one embodiment of the present invention.
Figure 5:
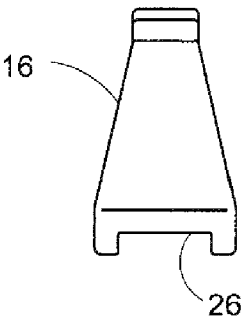
FIG. 5 is a side view of the frame portion of the present invention.
Figure 4:
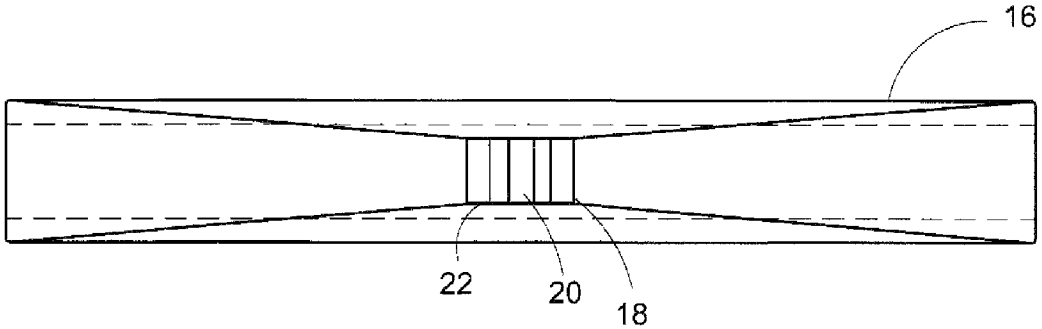
FIG. 4 is a top view of the frame portion of the present invention.
Figure 3:
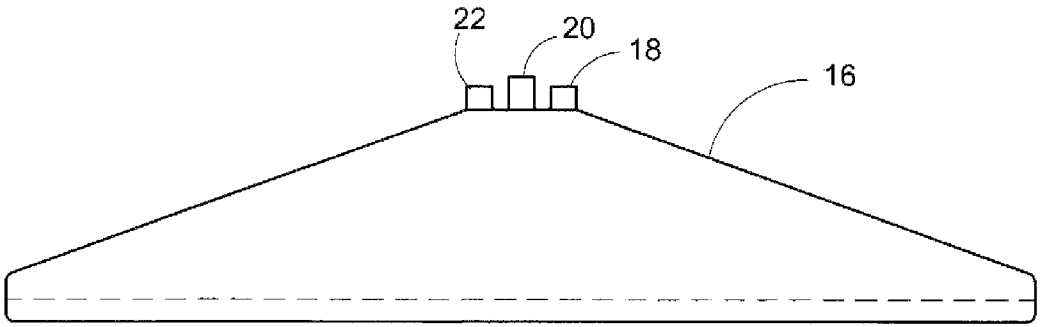
FIG. 3 is a front view of the frame portion of the present invention.

In use, a user will move string 14 outward from spline 12, position string 14 in the upper apex in at least one notch, secure the string, position the lower notch above spline 12 as shown in FIG. 1. The tension of string 14 holds frame 16 into position.

In use, a person will hold a guitar in one hand, grasp the assembly of the invention in the opposite hand, and draw the bow across the guitar strings. Although it might appear unnecessary to use the frame of the present invention and merely utilize a standard stringed instrument bow, the assembly of the present invention significantly improves control and manipulation when holding a guitar.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

We claim:

1. A method of playing an instrument, said method comprising the steps of:

providing an assembly for a string bow comprising:

a bow spline;

string stretched with tension along a portion of said spline;

a frame having an apex, said frame positioned between said spline and said string;

at least one string supporting member disposed on said apex; and a lower frame portion configured to contact said spline;

providing an article configured to produce sound when contacted with drawing motion of said string, said article being a guitar;

contacting the string of said assembly with said article configured to produce sound.

2. The method of claim 1 further comprising the use of more than one assembly with a single article configured to produce sound.

* * * * *